US010762824B2

(12) United States Patent
Chung

(10) Patent No.: US 10,762,824 B2
(45) Date of Patent: Sep. 1, 2020

(54) TIMING CONTROLLER AND DRIVING METHOD THEREOF

(71) Applicant: SAMSUNG DISPLAY CO., LTD., Yongin-si, Gyeonggi-do (KR)

(72) Inventor: Won Chang Chung, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 79 days.

(21) Appl. No.: 15/275,563

(22) Filed: Sep. 26, 2016

(65) Prior Publication Data

US 2017/0098403 A1 Apr. 6, 2017

(30) Foreign Application Priority Data

Oct. 1, 2015 (KR) ..... 10-2015-0138708

(51) Int. Cl.
*G09G 3/20* (2006.01)
*G09G 3/3266* (2016.01)
(Continued)

(52) U.S. Cl.
CPC ..... *G09G 3/2007* (2013.01); *G09G 3/3266* (2013.01); *G09G 3/3275* (2013.01);
(Continued)

(58) Field of Classification Search
CPC ..... G09G 2320/02; G09G 2320/0233; G09G 2320/0242; G09G 2320/0257;
(Continued)

(56) References Cited

U.S. PATENT DOCUMENTS 8,054,252 B2 11/2011 Tada et al.
9,430,964 B2 8/2016 Jeong et al.
(Continued)

FOREIGN PATENT DOCUMENTS

JP 2013-142775 A 7/2013
KR 10-1376324 B1 3/2014
(Continued)

*Primary Examiner* — Roberto W Flores
(74) *Attorney, Agent, or Firm* — Lewis Roca Rothgerber Christie LLP

(57) ABSTRACT

A timing controller includes a degradation quantity generator, a degradation quantity accumulator, a feedback data generator, and a feedback reflector. The degradation quantity generator generates a degradation quantity for each of a plurality of pixels in a display panel based on image data. The degradation quantity accumulator generates an accumulated degradation quantity based on the degradation quantity for each of the pixels. The feedback data generator generates feedback image data based on the accumulated degradation quantity. The feedback reflector generates image data, in which the degradation quantity is compensated, based on the image data and the feedback image data. An absolute value of the feedback image data, when the accumulated degradation quantity is a first accumulated degradation quantity level, is greater than an absolute value of the feedback image data when the accumulated degradation quantity is a second accumulated degradation quantity level higher than the first accumulated degradation quantity level.

13 Claims, 5 Drawing Sheets

(51) Int. Cl.
*G09G 3/3275* (2016.01)
*G09G 5/06* (2006.01)

(52) U.S. Cl.
CPC ..... *G09G 5/06* (2013.01); *G09G 2310/08* (2013.01); *G09G 2320/0233* (2013.01); *G09G 2320/0242* (2013.01); *G09G 2320/0271* (2013.01); *G09G 2320/043* (2013.01); *G09G 2330/10* (2013.01)

(58) Field of Classification Search
CPC .... G09G 2320/0271; G09G 2320/0285–0295; G09G 2320/04; G09G 2320/043–048; G09G 2320/0693; G09G 2330/10; G09G 3/006; G09G 3/2007; G09G 3/3208; G09G 3/3266; G09G 3/3275; H04N 17/00; H04N 17/004; H04N 17/02; G02F 1/1309
See application file for complete search history.

(56) References Cited

U.S. PATENT DOCUMENTS

2007/0236431 A1* 10/2007 Tada ..... G09G 3/3208 345/84
2012/0212516 A1* 8/2012 Ahn ..... G09G 3/3233 345/690
2012/0256971 A1* 10/2012 Shin ..... G09G 3/3233 345/690
2013/0002960 A1* 1/2013 Ryu ..... G09G 3/3225 348/607
2013/0057570 A1* 3/2013 Higaki ..... G09G 3/3225 345/589
2013/0176324 A1 7/2013 Yamashita et al.
2014/0168039 A1* 6/2014 Kim ..... G09G 3/3208 345/82
2014/0168191 A1* 6/2014 Byeon ..... G09G 3/3233 345/212
2014/0168192 A1* 6/2014 Jeong ..... G09G 3/3208 345/212
2014/0176617 A1* 6/2014 Jeong ..... G09G 3/2003 345/690
2014/0232409 A1* 8/2014 Keum ..... G09G 3/006 324/414
2014/0267465 A1 9/2014 Yamashita et al.
2014/0368556 A1* 12/2014 Funatsu ..... G09G 3/3241 345/690
2015/0187259 A1* 7/2015 Jeong ..... G09G 3/3233 345/690
2016/0086548 A1* 3/2016 Maeyama ..... G09G 3/3258 345/690

FOREIGN PATENT DOCUMENTS

KR 10-2014-0078502 A 6/2014
KR 10-2014-0098058 A 8/2014

* cited by examiner

TIMING CONTROLLER AND DRIVING METHOD THEREOF

CROSS-REFERENCE TO RELATED APPLICATION

Korean Patent Application No. 10-2015-0138708, filed on Oct. 1, 2015, and entitled, "Timing Controller and Driving Method Thereof," is incorporated by reference herein in its entirety.

BACKGROUND

1. Field

One or more embodiments described herein relate to a timing controller and a method for driving a timing controller.

2. Description of the Related Art

Various displays have been developed to replace cathode ray tubes. Examples include liquid crystal displays, field emission displays, plasma display panels, organic light emitting displays. In an organic light emitting display, the quantity of light emitted for a given gray scale value may decrease when the accumulated emission quantity is increased. Also, when the level of current supplied to an organic light emitting diode of a pixel in the display is increased (in an attempt to maintain quantity of light), the life span of the display may be reduced.

SUMMARY

In accordance with one or more embodiments, a timing controller includes a degradation quantity generator to generate a degradation quantity for each of a plurality of pixels in a display panel based on image data; a degradation quantity accumulator to generate an accumulated degradation quantity based on the degradation quantity for each of the pixels; a feedback data generator to generate feedback image data based on the accumulated degradation quantity; and a feedback reflector to generate image data, in which the degradation quantity is compensated, based on the image data and the feedback image data, wherein an absolute value of the feedback image data, when the accumulated degradation quantity is a first accumulated degradation quantity level, is greater than an absolute value of the feedback image data when the accumulated degradation quantity is a second accumulated degradation quantity level higher than the first accumulated degradation quantity level.

The feedback data generator may include a scaling factor generator to generate a scaling factor; a scaling factor application rate generator to generate a scaling factor application rate based on the accumulated degradation quantity; and a scaling factor calculator to calculate the feedback image data based on the scaling factor and the scaling factor application rate.

The scaling factor application rate, when the accumulated degradation quantity is the first accumulated degradation quantity level, may be greater than the scaling factor application rate when the accumulated degradation quantity is the second accumulated degradation quantity level, and the feedback image data may be based on the following equation:

$$fRGB=(1-R)+R\times SF$$

where fRGB is the feedback image data, R is the scaling factor application rate, and SF is the scaling factor.

When a level of the accumulated degradation quantity is in a first range, a level of the scaling factor application rate may be in a second range different from the first range, and the scaling factor may be generated based on the accumulated degradation quantity. The first range may be greater than the second range.

The timing controller may include a look-up table which is to output the feedback image data corresponding to the received scaling factor and scaling factor application rate. The accumulated degradation quantity may include sub accumulated degradation quantities for each pixel, and the feedback image data may includes sub feedback image data for each pixel.

In accordance with one or more other embodiments, a method for driving a timing controller includes generating a degradation quantity for each of a plurality of pixels in a display panel based on image data; generating an accumulated degradation quantity based on the degradation quantity for each of the pixels; generating feedback image data based on the accumulated degradation quantity; and generating image data, in which the degradation quantity is compensated, based on the image data and the feedback image data, wherein an absolute value of the feedback image data when the accumulated degradation quantity is a first accumulated degradation quantity level is greater than an absolute value of the feedback image data when the accumulated degradation quantity is a second accumulated degradation quantity level higher than the first accumulated degradation quantity level.

Generating the feedback image data may include generating a scaling factor; generating a scaling factor application rate based on the accumulated degradation quantity; and calculating the feedback image data based on the scaling factor and the scaling factor application rate. The feedback image data may be expressed by the following equation:

$$fRGB=(1-R)+R\times SF$$

where fRGB is the feedback image data, R is the scaling factor application rate, and SF is the scaling factor.

When a level of the accumulated degradation quantity is in a first range, a level of the scaling factor application rate in a second range may be different from the first range, and the scaling factor may be generated based on the accumulated degradation quantity. The first range may be greater than the second range.

In accordance with one or more other embodiments, an apparatus includes first logic to generate a degradation quantity for each of a plurality of pixels based on first image data; second logic to generate an accumulated degradation quantity based on the degradation quantity for each of the pixels; third logic to generate feedback image data based on the accumulated degradation quantity; and fourth logic to generate second image data for output to a display, the second image data corresponds to a compensated degradation quantity based on the first image data and the feedback image data.

An absolute value of the feedback image data, when the accumulated degradation quantity is a first accumulated degradation quantity level, may be greater than an absolute value of the feedback image data when the accumulated degradation quantity is a second accumulated degradation quantity level higher than the first accumulated degradation quantity level. The third logic may generate a scaling factor; generate a scaling factor application rate based on the accumulated degradation quantity; and calculate the feedback image data based on the scaling factor and the scaling factor application rate.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
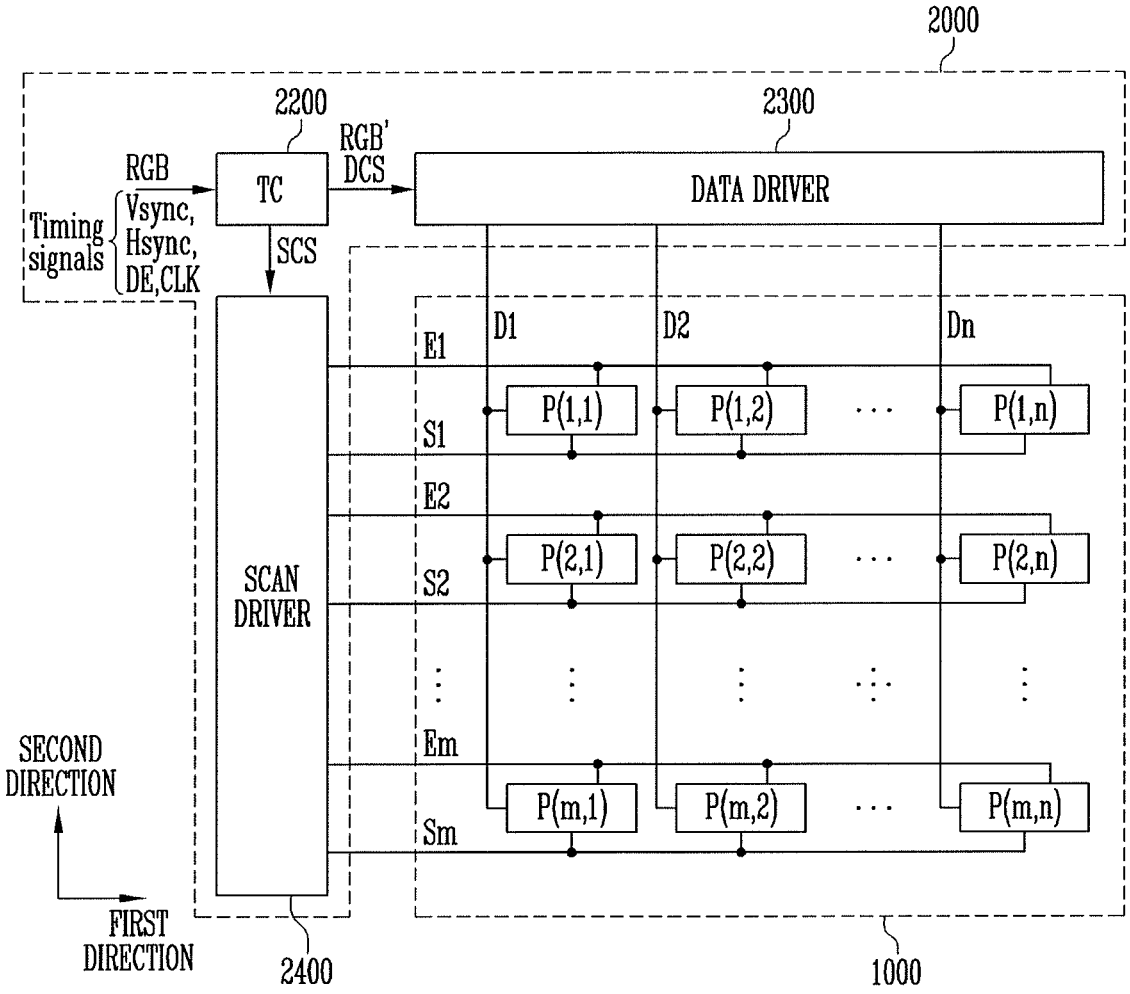
FIG. 1 illustrates an embodiment of an organic light emitting display device.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. The embodiments may be combined to form additional embodiments.

In the drawings, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

When an element is referred to as being "connected" or "coupled" to another element, it can be directly connected or coupled to the another element or be indirectly connected or coupled to the another element with one or more intervening elements interposed therebetween. In addition, when an element is referred to as "including" a component, this indicates that the element may further include another component instead of excluding another component unless there is different disclosure.

FIG. 1 illustrates an embodiment of an organic light emitting display device including a display panel 1000 and a display panel driver 2000. The display panel 1000 includes pixels P(1, 1) to P(m, n) (m and n equal to or larger than 2), m scan lines S1 to Sm which transmit scan signals to the pixels P(1, 1) to P(m, n) and extend in a first direction, n data lines D1 to Dn which transmit data voltages to the pixels P and extend in a second direction, and m emission control lines E1 to Em which transmit emission control signals to the pixels P and extend in the first direction. Each pixel P(i, j) may be electrically connected to a corresponding scan line Si, data line Dj, and emission control line Ei. In another embodiment, two or more scan lines Si and Si−1 may be electrically connected to each pixel P(i, j).

The display panel driver 2000 generates data voltages for input to the data lines D, scan signals for input to the scan lines S, and emission control signals for input to the emission control lines E in order to drive the display panel 1000. The display panel driver 2000 includes a timing controller (TC) 2200, a data driver 2300, and a scan driver 2400. The timing controller 2200, the data driver 2300, and the scan driver 2400 may be implemented by separate electronic devices, or the entire display panel driver 2000 may be implemented by one electronic device (for example, a display driving Integrated Circuit (IC)).

The timing controller 2200 receives image data RGB and timing signals from a source. The image data RGB includes gray scale values for the pixels P. According to an exemplary embodiment, the gray scale values may be in a range of 0 to 255. When the gray scale value is low, the luminance of light emitted by a pixel is low, e.g., a gray scale value of 0 may correspond to black.

The timing signals include a vertical synchronization signal Vsync, a horizontal synchronization signal Hsync, a data enable signal DE, and a dot clock signal CLK. The timing controller 2200 generates timing control signals for controlling operation timings of the data driver 2300 and the scan driver 2400 based on the timing signals. The timing control signals include a data timing control signal DCS for controlling an operation timing and a data sampling start timing of the data driver 2300, and a scan timing control signal SCS for controlling an operation timing of the scan driver 2400.

The timing controller 2200 performs compensation on the image data RUB in consideration of an accumulated degradation quantity and outputs compensated image data RGB' to the data driver 2300 for displaying an image.

The data driver 2300 latches the compensated image data RGB' from the timing controller 2200 based on the data timing control signal DCS. In one embodiment, the data driver 2300 may include a plurality of source drive ICs electrically connected to the data lines D of the display panel 1000, for example, by a Chip On Glass (COG) process or a Tape Automated Bonding (TAB) process.

The scan driver 2400 sequentially supplies the scan signals to the scan lines S based on the scan timing control signal SCS and sequentially applies the emission control signals to the emission control lines E. The scan driver 2400 may be directly formed on a substrate of the display panel 1000, for example, by a Gate In Panel (GIP) scheme, or may be electrically connected to the scan lines S and the emission control lines E by the TAB scheme.

Figure 2:
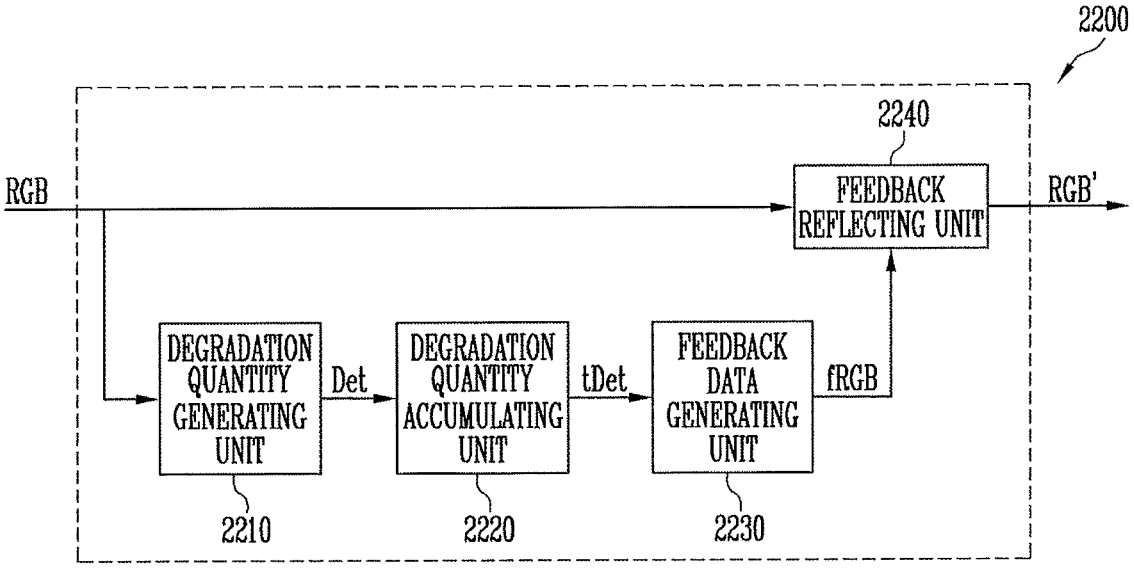
FIG. 2 illustrates an embodiment of a timing controller.

FIG. 2 illustrates an embodiment of a timing controller, which, for example, may correspond to timing controller 2200. For convenience, it is assumed that the image data RGB is image data during 1 frame period for all of the pixels P.

Referring to FIGS. 1 and 2, the timing controller 2200 includes a degradation quantity generating unit 2210, a degradation quantity accumulating unit 2220, a feedback data generating unit 2230, and a feedback reflecting unit 2240.

The degradation quantity generating unit 2210 generates degradation quantities Det based on the image data RGB. The degradation quantities Det include degradation quantities of the respective pixels P. For example, for one pixel P(i, j), the degradation quantity generating unit 2210 may extract a gray scale value corresponding to the pixel P(i, j) in the image data RGB and may calculate the degradation quantity of the pixel P(i, j) corresponding to the extracted gray scale value. When the calculation is performed on all of the pixels P, degradation quantities of all of the pixels P are generated. The degradation quantities Det include degradation quantities of the respective pixels P. According to an exemplary embodiment, the degradation quantity generating unit 2210 may include, for example, a look-up table which outputs a degradation quantity when a gray scale value is input.

The degradation quantity accumulating unit 2220 generates an accumulated degradation quantity tDet based on the degradation quantities Det. The accumulated degradation quantity tDet includes an accumulated degradation quantity of all the pixels P, in which degradation quantities of the respective pixels P are all added. According to an exemplary embodiment, the accumulated degradation quantity tDet may also include accumulated degradation quantities for the respective pixels P, in which degradation quantities of the respective pixels P are added for each pixel.

The feedback data generating unit 2230 generates feedback image data fRGB based on the accumulated degradation quantity tDet. The feedback image data fRGB includes feedback gray scale values corresponding to the pixels P. When an absolute value of the feedback image data fRGB is large, the degradation quantity may be compensated to a greater degree. According to an exemplary embodiment, the feedback image data fRGB may also include sub feedback image data for each pixel.

The feedback reflecting unit 2240 generates the image data RGB', in which the degradation quantity is compensated, based on the image data RGB and the feedback image data fRGB. The compensated image data RGB' includes compensated gray scale values corresponding to the pixels P. The compensated gray scale values may be generated by adding the feedback gray scale values within the feedback image data fRGB to the gray scale values within the image data RGB or by subtracting the feedback gray scale values within the feedback image data fRGB from the gray scale values within the image data RGB.

In FIG. 2, the degradation quantity generating unit 2210, the degradation quantity accumulating unit 2220, the feedback data generating unit 2230, the feedback reflecting unit 2240 are separated. In another embodiment, two or more of the degradation quantity generating unit 2210, the degradation quantity accumulating unit 2220, the feedback data generating unit 2230, the feedback reflecting unit 2240 may be implemented in one IC.

Figure 3:
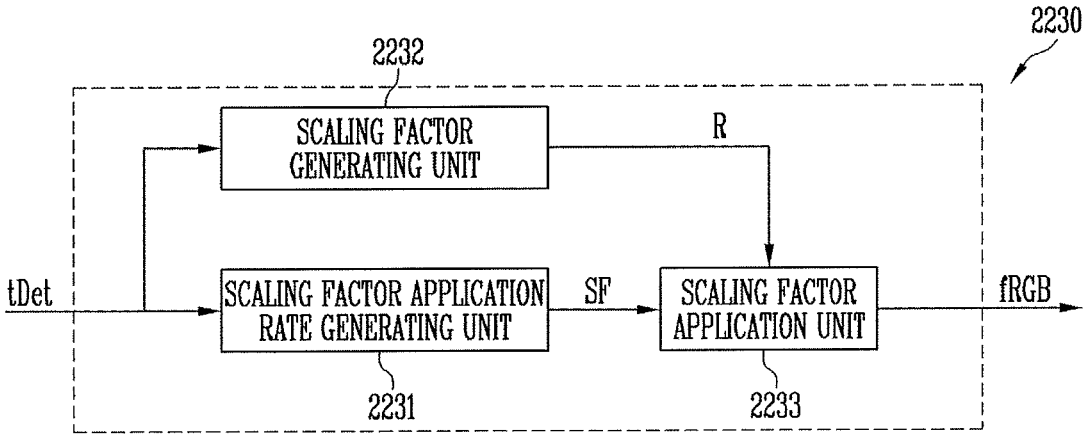
FIG. 3 illustrates an embodiment of a feedback data generating unit.

FIG. 3 illustrates an embodiment of a feedback data generating unit, which, for example, may correspond to feedback data generating unit 2230 in FIG. 2. Referring to FIG. 3, the feedback data generating unit 2230 includes a scaling factor generating unit 2231, a scaling factor application rate generating unit 2232, and a scaling factor applying unit 2233. The scaling factor generating unit 2231 generates a scaling factor SF.

The scaling factor application rate generating unit 2232 generates a scaling factor application rate R based on the accumulated degradation quantity tDet. For example, when the level of the accumulated degradation quantity tDet is high (e.g., above a predetermined value), a low scaling factor application rate R is generated. For example, when the accumulated degradation quantity tDet is increased, the scaling factor application rate R is decreased.

The scaling factor application unit 2233 calculates the feedback image data fRGB based on the scaling factor SF generated by the scaling factor generating unit 2231 and the scaling factor application rate R generated by the scaling factor application rate generating unit 2232. The scaling factor applying unit 2233 may include a look-up table. When the scaling factor applying unit 2233 receives the scaling factor SF and the scaling factor application rate R, the look-up table may output the feedback image data fRGB corresponding to the received scaling factor SF and scaling factor application rate R. The feedback image data fRGB may be expressed by Equation 1.

$$fRGB=(1-R)+R\times SF \quad (1)$$

where fRGB is feedback image data, R is scaling factor application rate, and SF is a scaling factor.

When the scaling factor SF is larger than 1 and when the scaling factor application rate R is large (e.g., above a predetermined value), the absolute value of the feedback image data fRGB is large and a change in luminance due to degradation is compensated to a greater extent. When the level of the accumulated degradation quantity tDet is high (e.g., above a predetermined value), the scaling factor application rate R is low. Thus, the absolute value of the feedback image data fRGB is decreased. For example, the absolute value of the image data fRGB when the accumulated degradation quantity tDet has a first level is greater than an absolute value of the feedback image data when the accumulated degradation quantity tDet has a second level that is higher than the first level. Thus, when the accumulated degradation quantity is large (e.g., above a predetermined value), the degree of compensation of degradation quantity is decreased.

In FIG. 3, the scaling factor generating unit 2231, the scaling factor application rate generating unit 2232, and the scaling factor applying unit 223 are separated. In another embodiment, two or more of the scaling factor generating unit 2231, the scaling factor application rate generating unit 2232, and the scaling factor applying unit 223 may be implemented in one IC.

Figure 4:
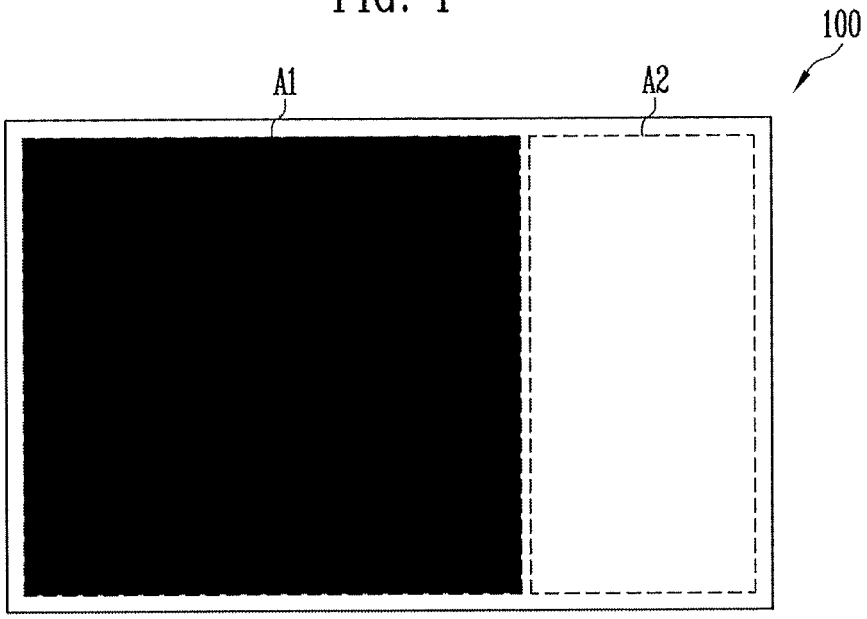
FIGS. 4 and 5 illustrate examples of displayed images.
Figure 5:
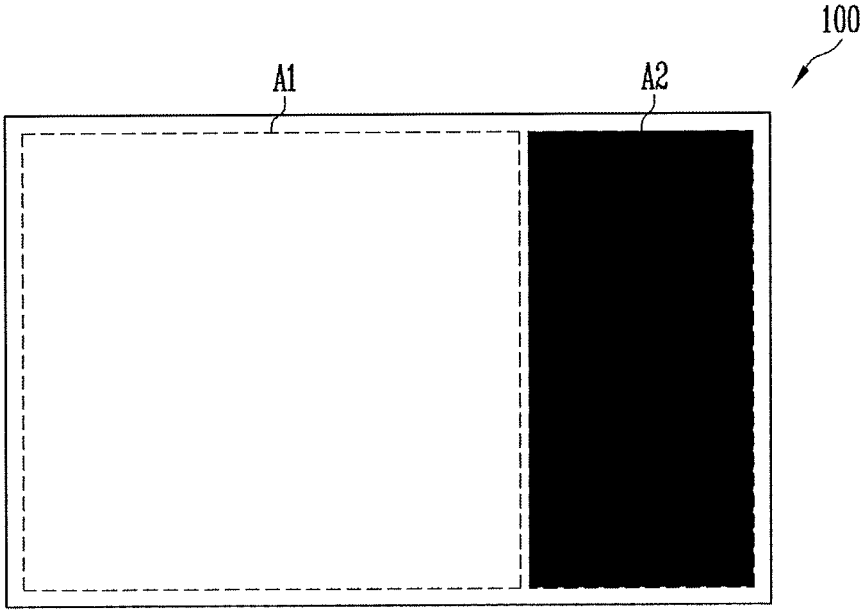
Figure 6:
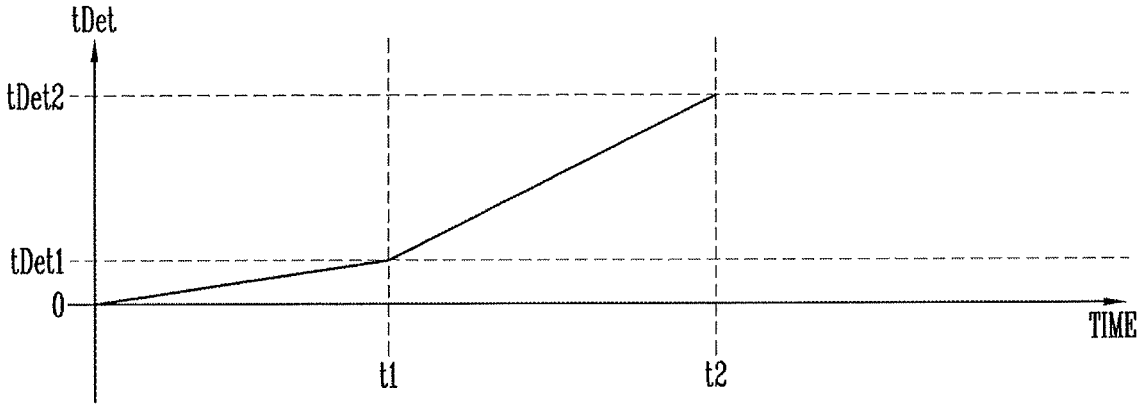
FIG. 6 illustrates an example of an accumulated degradation quantity.
Figure 7:
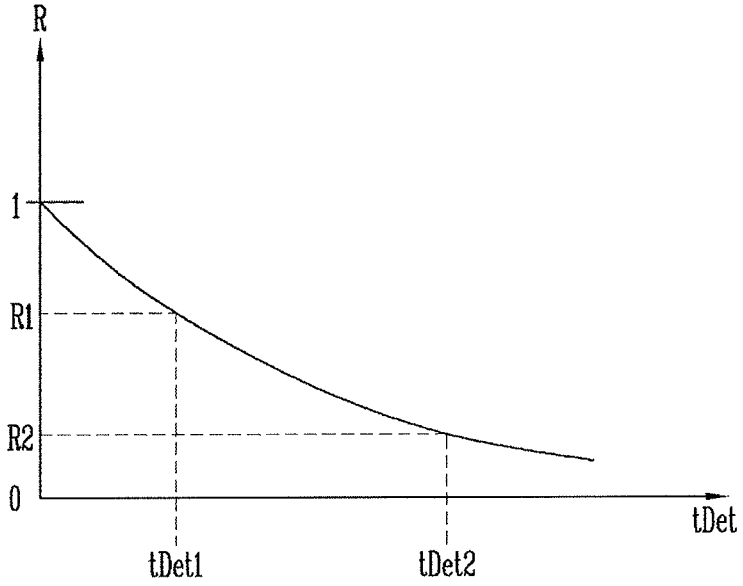
FIG. 7 illustrates an example of a change in a scaling factor application rate.

FIGS. 4 and 5 illustrate examples of images displayed by the organic light emitting display device of FIG. 1. FIG. 6 is a graph illustrating an example of an accumulated degradation quantity generated by the degradation quantity accumulating unit during the display of the image in FIGS. 4 and 5. FIG. 7 is a graph illustrating a change in a scaling factor application rate generated by the scaling factor application rate generating unit during the display of the image of FIGS. 4 and 5. In the following description, the accumulated degradation quantity tDet includes an accumulated degradation quantity of all the pixels P, in which degradation quantities of the respective pixels P are all added.

FIG. 4 illustrates an image displayed in a section from a time of 0 to a first time t1 (see FIG. 6), and FIG. 5 illustrates an image displayed in a section from the first time t1 to a second time t2 (see FIG. 6) that is after the first time t1 (see FIG. 6).

Referring to FIG. 4, in the section from the time of 0 to the first time t1, the gray scale value of a portion corresponding to a first area A1 in the image data RGB is 0 (e.g., black). As a result, the portion corresponding to the first area A1 in the display panel 1000 does not emit light. The gray scale value of a portion corresponding to a second area A2 (which does not overlap the first area A1 in the image data RGB, see FIG. 1) is greater than 0. As a result, the portion corresponding to the second area A2 in the display panel 1000 emits light. Thus, only the pixels in the second area A2 emit light, and thus are subject to being degraded due to emission. (For convenience of the description, it may be assumed that the gray scale values of the pixels in the second area A2 in the image data RGB are the same as each other, but this is only an example and is not necessary). In the section from time t=0 to time t1, some portions of the display panel 1000 emit light. Therefore, the accumulated degradation quantity tDet (see FIG. 6) is increased.

Referring to FIG. 5, in the section from time t1 to time t2, the gray scale value of the portion corresponding to the first area A1 in the image data RGB is greater than 0. As a result, the portion corresponding to the first area A1 in the display panel 1000 emits light. The gray scale value of the portion corresponding to the second area A2 in the image data RGB is 0. As a result, the portion corresponding to the second area A2 in the display panel 1000 does not emit light. Thus, only the pixels in the first area A1 emit light, and therefore are subject to being degraded due to emission. (For convenience of the description, it may be assumed that the gray scale values of the pixels in the first area A1 in the image data RGB are the same as each other and are the same as the gray scale values of the pixels in the second area A2 in the image data RGB from the time=0 to time t1, but this is only an example and is not necessary.) In the section from time t1 to time t2, some portions of the display panel 1000 emit light. Therefore, the accumulated degradation quantity tDet is increased.

Referring to FIG. 6, the accumulated degradation quantity tDet in the section from time=0 to second time t2 is increased. At first time t1, the level of the accumulated degradation quantity tDet is a first accumulated degradation quantity level tDet1. At the second time t2, the level of the accumulated degradation quantity tDet is a second accumulated degradation quantity level tDet2. In FIG. 6, the curve for time t between first time t1 and the second time t2 has a greater slope than the slope of the curve between time t=0 to first time t1. The curve may have different slopes in another embodiment.

Referring to FIG. 7, at first time t1, the accumulated degradation quantity tDet is the first accumulated degradation quantity level tDet1. Thus, the scaling factor application rate generating unit 2232 (see, e.g., FIG. 3) generates a first scaling factor application rate R1. At the second time t2, the accumulated degradation quantity tDet is the second accumulated degradation quantity level tDet2. Thus, the scaling factor application rate generating unit 2232 (see, e.g., FIG. 3) generates a second scaling factor application rate R2. In this embodiment, the first scaling factor application rate R1 is greater than the second scaling factor application rate R2. Thus, when the accumulated degradation quantity tDet is increased, the scaling factor application rate R is decreased.

The first scaling factor application rate R1 is greater than the second scaling factor application rate R2. Thus, the absolute value of the feedback image data fRGB (see, e.g., FIG. 2) at first time t1 is greater than the absolute value of the feedback image data fRGB (see, e.g., FIG. 2 at second time t2.

Figure 8:
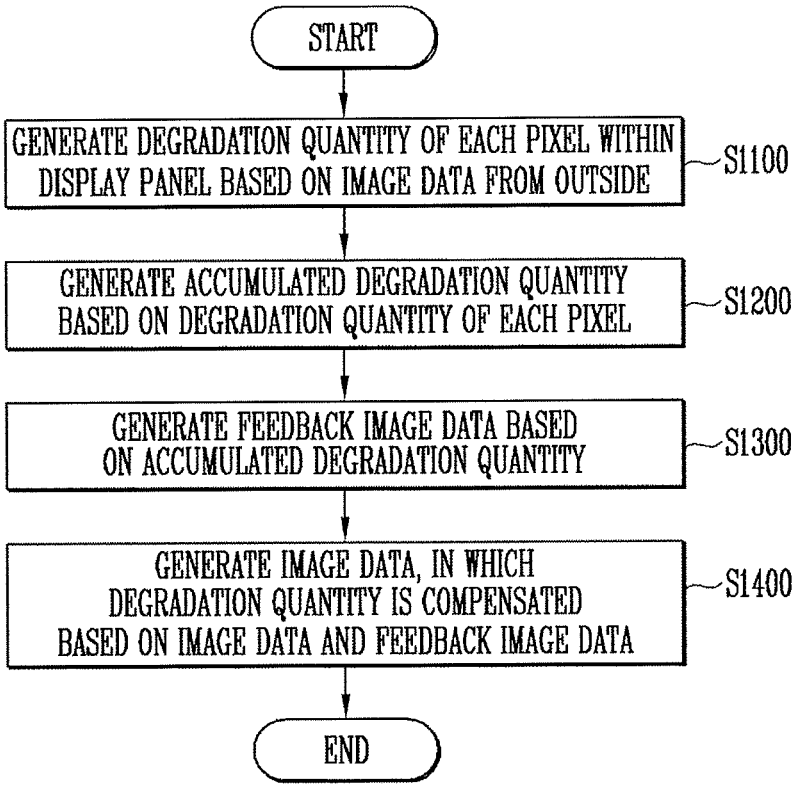
FIG. 8 illustrates an embodiment of a method for driving a timing controller.

FIG. 8 illustrates an embodiment of a method for driving a timing controller, which, for example, may correspond to timing controller 2200 in FIG. 1. For illustrative purposes only the method will be described with reference to FIGS. 1 to 8.

In operation S1100, the degradation quantity generating unit 2210 generates degradation quantities Det based on image data RGB from a source. The degradation quantities Det include degradation quantities of respective pixels P.

In operation S1200, the degradation quantity accumulating unit 2220 generates an accumulated degradation quantity tDet based on the degradation quantities of respective pixels in the degradation quantities Det. The accumulated degradation quantity tDet may include accumulated degradation quantities for respective pixels P, in which degradation quantities of the respective pixels P are added for each pixel. The accumulated degradation quantity tDet may include an accumulated degradation quantity of all the pixels P, in which the degradation quantities of the respective pixels are added.

In operation S1300, the feedback data generating unit 2230 generates feedback image data fRGB based on the accumulated degradation quantity tDet.

In operation S1400, the feedback reflecting unit 2240 generates compensated image data RGB' based on the image data RGB and the feedback image data fRGB from the feedback data generating unit 2230.

Figure 9:
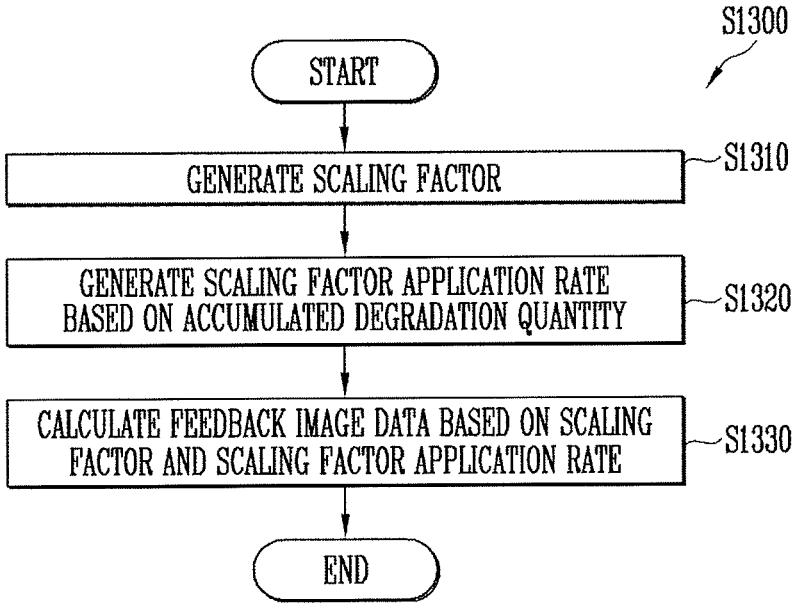
FIG. 9 illustrates an embodiment for generating feedback image data.

FIG. 9 illustrates an embodiment of an operation for generating feedback image data based on the accumulated degradation quantity of FIG. 8. Operation S1300 includes operation S1310, operation S1320, and operation S1330.

In operation S1310, the scaling factor generating unit 2231 generates a scaling factor SF. According to an exemplary embodiment, the scaling factor SF may also be formed based on the accumulated degradation quantity tDet.

In operation S1320, the scaling factor application rate generating unit 2232 generates a scaling factor application rate R based on the accumulated degradation quantity tDet. When the accumulated degradation quantity tDet is increased, the scaling factor application rate R is decreased as described above.

In operation S1330, the scaling factor applying unit 2233 generates the feedback image data fRGB based on the scaling factor SF and the scaling factor application rate R. The feedback image data fRGB is inversely proportional to the accumulated degradation quantity tDet.

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods described herein.

The controllers, units, drivers, and other processing features of the embodiments disclosed herein may be implemented in logic which, for example, may include hardware, software, or both. When implemented at least partially in hardware, the controllers, units, drivers, and other processing features may be, for example, any one of a variety of integrated circuits including but not limited to an application-specific integrated circuit, a field-programmable gate array, a combination of logic gates, a system-on-chip, a microprocessor, or another type of processing or control circuit.

When implemented in at least partially in software, the controllers, units, drivers, and other processing features may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods described herein.

By way of summation and review, in at least one type of an organic light emitting display, the quantity of light emitted in response to a same gray scale value is decreased when an accumulated emission quantity is increased. Also, when the level of current supplied to an organic light emitting diode of a pixel of the display is increased (in an attempt to maintain quantity of light), the life span of the display may be reduced.

In accordance with one or more of the aforementioned embodiments, a timing controller and a method for driving a timing controller in an organic light emitting display increases the life span of the display by decreasing the quantity of fed-back gray scale values when an accumulated emission quantity is increased.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the embodiments set forth in the claims.

What is claimed is:

1. A timing controller, comprising:

a degradation quantity generator to receive first image data and to generate a degradation quantity for each of a plurality of pixels in a display panel based on predetermined degradation quantities corresponding to grey scales, respectively, and a grey scale of the first image data in which the degradation quantity is not yet compensated;

a degradation quantity accumulator to generate an accumulated degradation quantity based on the degradation quantity for each of the pixels;

a feedback data generator to generate feedback image data based the accumulated degradation quantity; and feedback reflecting unit to generate second image data, in which the degradation quantity is compensated, based on the first image data and the feedback image data, wherein, when the accumulated degradation quantity is increased, a degree of compensation of the degradation quantity of the first image data is decreased, wherein an absolute value of the feedback image data, when the accumulated degradation quantity is a first accumulated degradation quantity level, is greater than an absolute value of the feedback image data when the accumulated degradation quantity is a second accumulated degradation quantity level higher than the first accumulated degradation quantity level, wherein the feedback reflecting unit generates the second image data which is compensated accumulated degradation quantity based on accumulated degradation quantity of all of the pixels, in which degradation quantities of all of the pixels are all added, wherein the accumulated degradation quantity increases over time, and wherein the feedback image data is inversely proportional to the accumulated degradation quantity over time.

2. The timing controller as claimed in claim 1, wherein the feedback data generator includes:

a scaling factor generator to generate a scaling factor;

a scaling factor application rate generator to generate a scaling factor application rate based on the accumulated degradation quantity; and a scaling factor calculator to calculate the feedback image data based on the scaling factor and the scaling factor application rate.

3. The timing controller as claimed in claim 2, wherein: the scaling factor application rate, when the accumulated degradation quantity is the first accumulated degradation quantity level, is greater than the scaling factor application rate when the accumulated degradation quantity is the second accumulated degradation quantity level, and the feedback image data is based on the following equation:

$$fRGB=(1-R)+R\times SF$$

where fRGB is the feedback image data, R is the scaling factor application rate, and SF is the scaling factor.

4. The timing controller as claimed in claim 3, wherein:

when a level of the accumulated degradation quantity increases, a level of the scaling factor application rate decreases, and the scaling factor is generated based on the accumulated degradation quantity.

5. The timing controller as claimed in claim 2, further comprising:

a look-up table which is to output the feedback image data corresponding to the scaling factor and scaling factor application rate.

6. The timing controller as claimed in claim 1, wherein:

the accumulated degradation quantity includes sub accumulated degradation quantities for each pixel, and the feedback image data includes sub feedback image data for each pixel.

7. A method for driving a timing controller, comprising:

receiving first image data;

generating a degradation quantity for each of a plurality of pixels in a display panel based on predetermined degradation quantities corresponding to grey scales, respectively, and a grey scale of the first image data in which the degradation quantity is not yet compensated;

generating an accumulated degradation quantity based on the degradation quantity for each of the pixels;

generating feedback image data based on the accumulated degradation quantity; and generating second image data, in which the degradation quantity is compensated, based on the first image data and the feedback image data, wherein, when the accumulated degradation quantity is increased, a degree of compensation of the degradation quantity of the first image data is decreased, wherein an absolute value of the feedback image data when the accumulated degradation quantity is a first accumulated degradation quantity level is greater than an absolute value of the feedback image data when the accumulated degradation quantity is a second accumulated degradation quantity level higher than the first accumulated degradation quantity level, wherein the feedback image data is based on accumulated degradation quantity of all of the pixels, in which degradation quantities of all of the pixels are all added, wherein the accumulated degradation quantity increases over time, and wherein the feedback image data is inversely proportional to the accumulated degradation quantity over time.

8. The method as claimed in claim 7, wherein generating the feedback image data includes:

generating a scaling factor;

generating a scaling factor application rate based on the accumulated degradation quantity; and calculating the feedback image data based on the scaling factor and the scaling factor application rate.

9. The method as claimed in claim 8, wherein the feedback image data is expressed by the following equation:

$$fRGB=(1-R)+R\times SF$$

where fRGB is the feedback image data, R is the scaling factor application rate, and SF is the scaling factor.

10. The method as claimed in claim 9, wherein:

when a level of the accumulated degradation quantity increases, a level of the scaling factor application rate decreases, and the scaling factor is generated based on the accumulated degradation quantity.

11. An apparatus, comprising:

first logic configured to receive first image data and to generate a degradation quantity for each of a plurality of pixels based on predetermined degradation quantities corresponding to grey scales, respectively, and a grey scale of the first image data in which the degradation quantity is not yet compensated;

second logic configured to generate an accumulated degradation quantity based on the degradation quantity for each of the pixels;

third logic configured to generate feedback image data based on the accumulated degradation quantity; and fourth logic configured to generate second image data for output to a display, wherein the second image data corresponds to a compensated degradation quantity based on the first image data and the feedback image data, wherein, when the accumulated degradation quantity is increased, a degree of compensation of the degradation quantity of the first image data is decreased, wherein the feedback image data is based on accumulated degradation quantity of all of the pixels, in which degradation quantities of all of the pixels are all added, wherein the accumulated degradation quantity increases over time, and wherein the feedback image data is inversely proportional to the accumulated degradation quantity over time.

12. The apparatus as claimed in claim 11, wherein an absolute value of the feedback image data, when the accumulated degradation quantity is a first accumulated degradation quantity level, is greater than an absolute value of the feedback image data when the accumulated degradation quantity is a second accumulated degradation quantity level higher than the first accumulated degradation quantity level.

13. The apparatus as claimed in claim 11, wherein the third logic is configured to:

generate a scaling factor;

generate a scaling factor application rate based on the accumulated degradation quantity; and calculate the feedback image data based on the scaling factor and the scaling factor application rate.

* * * * *